US006247973B1

(12) United States Patent
Chawa et al.

(10) Patent No.: US 6,247,973 B1
(45) Date of Patent: Jun. 19, 2001

(54) POWER DISTRIBUTION SYSTEM FOR MOTOR VEHICLE REAR LIGHT ASSEMBLIES

(75) Inventors: Charanjit S. Chawa, Sterling Heights, MI (US); Joseph A. Bertucci, Portland, OR (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/379,691

(22) Filed: Aug. 24, 1999

(51) Int. Cl.[7] ..... H01R 11/09
(52) U.S. Cl. ..... 439/723; 439/39
(58) Field of Search ..... 439/34, 723, 724, 439/736, 949, 76.2; 307/10

(56) References Cited

U.S. PATENT DOCUMENTS 4,577,917 * 3/1986 Nashimoto et al. ..... 439/949
5,207,591 * 5/1993 Ozaki et al. ..... 439/724
5,322,445 * 6/1994 Ozaki et al. ..... 439/724
5,501,605 * 3/1996 Ozaki et al. ..... 439/34

* cited by examiner

*Primary Examiner*—Gary F. Paumen
*Assistant Examiner*—Alexander Gilman
(74) *Attorney, Agent, or Firm*—Richard A. Jones

(57) ABSTRACT

A power distribution system for a motor vehicle having a left tail light assembly, a license plate light assembly and a right tail light assembly includes a power distribution block that has a plurality of bus strips embedded in the distribution block with each of the bus strips having at least one tab terminal that projects into an integral input connector socket and at least one tab terminal that projects into at least one of first, second and third output connector sockets. A spliceless chassis wiring harness is plugged into the input connector socket for energizing lights in the left tail light assembly, the license plate light assembly and the right tail light assembly via three spliceless output wiring harnesses operatively associated with the respective output connector sockets and the light assemblies. The power distribution system may also include optional right and left side marker light assemblies that are operatively associated with the second output connector socket.

19 Claims, 3 Drawing Sheets

POWER DISTRIBUTION SYSTEM FOR MOTOR VEHICLE REAR LIGHT ASSEMBLIES

TECHNICAL FIELD

This invention relates generally to power distribution systems and more particularly to a power distribution system for truck rear light assemblies.

BACKGROUND OF THE INVENTION

Trucks and other motor vehicles typically have left and right tail light assemblies and a rear license plate light assembly. The tail light assemblies usually include stop lights, turning signal lights, running lights and back up lights. The several lights of these assemblies are usually connected to a power source in the front of the vehicle by a wiring harness or harnesses that have several splices to provide individual leads to the right tail light assembly, the left tail light assembly and the license plate light assembly, respectively.

These known power distribution systems have a disadvantage in that it is difficult and expensive to provide cable splices in a wiring harness.

SUMMARY OF THE INVENTION

This invention provides a power distribution system for motor vehicle rear light assemblies that eliminates any need for cable splices. The system incorporates a bussing block that can be mounted on the rear of the vehicle and that is fed by a spliceless chassis wiring harness. The bussing block in turn is connected to the left and right tail light assemblies and to the license plate light assembly by three spliceless wiring harnesses. The power distribution system may feed side marker light assemblies as an option.

DESCRIPTION OF THE PREFERRED EMBODIMENT

Figure 1:
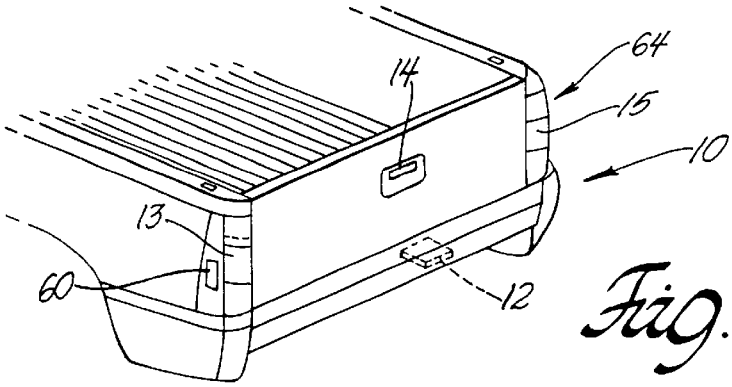
FIG. 1 is a perspective view of a motor vehicle (specifically a truck) equipped with a power distribution system in accordance with the invention.

Referring now to the drawing, FIG. 1 shows the aft end of a truck 10 that is equipped with a bussing block 12 for distributing electrical power to a left hand tail light assembly 13, a license plate light assembly 14 and a right hand tail light assembly 15. Bussing block 12 is attached to the cross sill 16 of the truck by a bracket 17. The bussing block 12 and bracket 17 are shaped to facilitate attachment of bussing block 12 to bracket 17 as described in detail in pending U.S. patent application Ser. No. 09/302,114 filed Apr. 29, 1999 by Gary Detter and assigned to the assignee of this invention.

Figure 2:
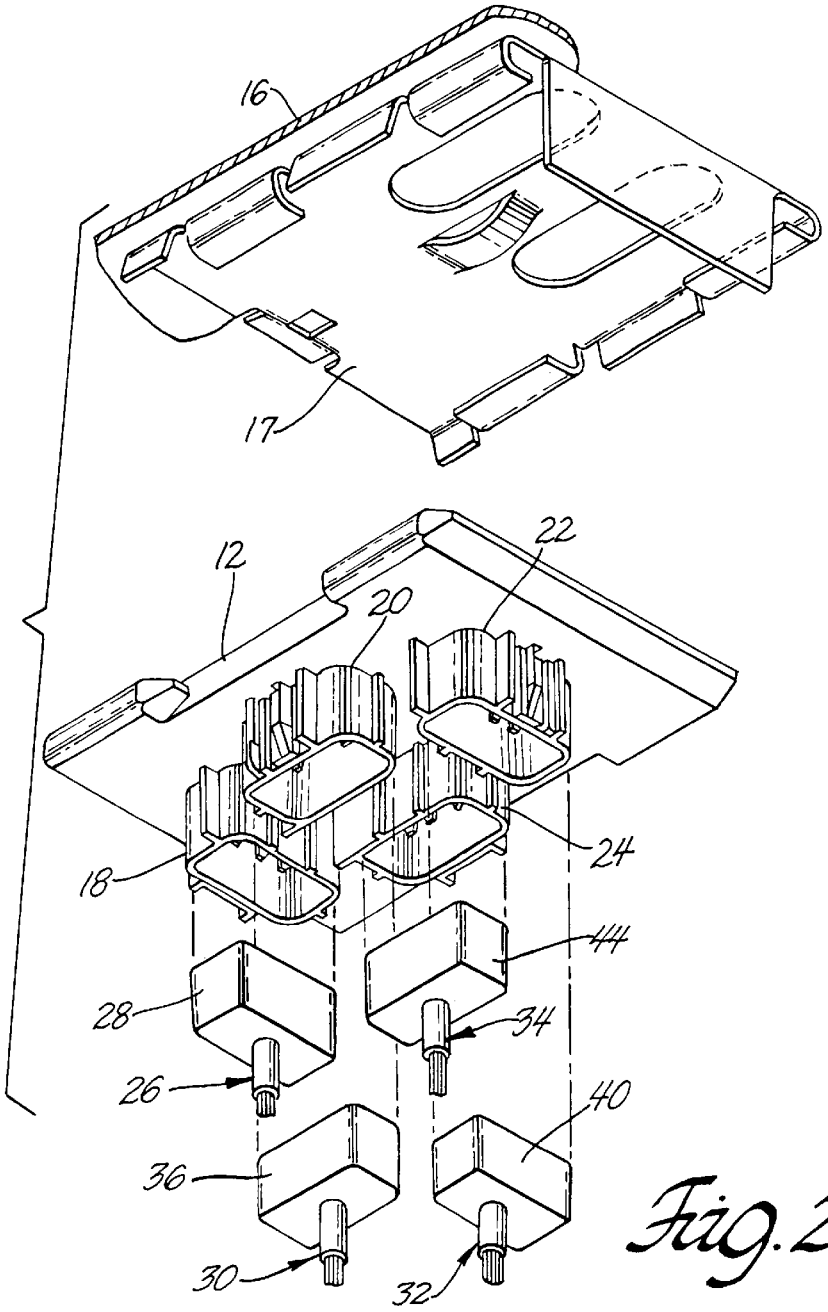
FIG. 2 is an enlarged exploded perspective view of a portion of the power distribution system shown in FIG. 1.

Bussing block 12 has four integral socket connectors 18, 20, 22 and 24 as best shown in FIG. 2. Bussing block 14 is fed electrical power by a spliceless chassis wiring harness 26 that has an end connector 28 that plugs into input connector 18. Bussing block 12 distributes the electrical power to the three light assemblies 13, 14 and 15 via three distinct and separately spliceless wiring harnesses: a first wiring harness 30, a second wiring harness 32, and a third wiring harness 34. First wiring harness 30 has an end connector 36 that plugs into output connector 20 and a second end connector (not shown) that plugs into the left hand tail light assembly 13. Third wiring harness 32 has an end connector 40 that plugs into output connector 22 and a second end connector (not shown) that plugs into the license plate light assembly 14. Wiring harness 34 has an end connector 44 that plugs into output connector 24 and a second end connector (not shown) that plugs into the right hand tail light assembly 15.

Figure 4:
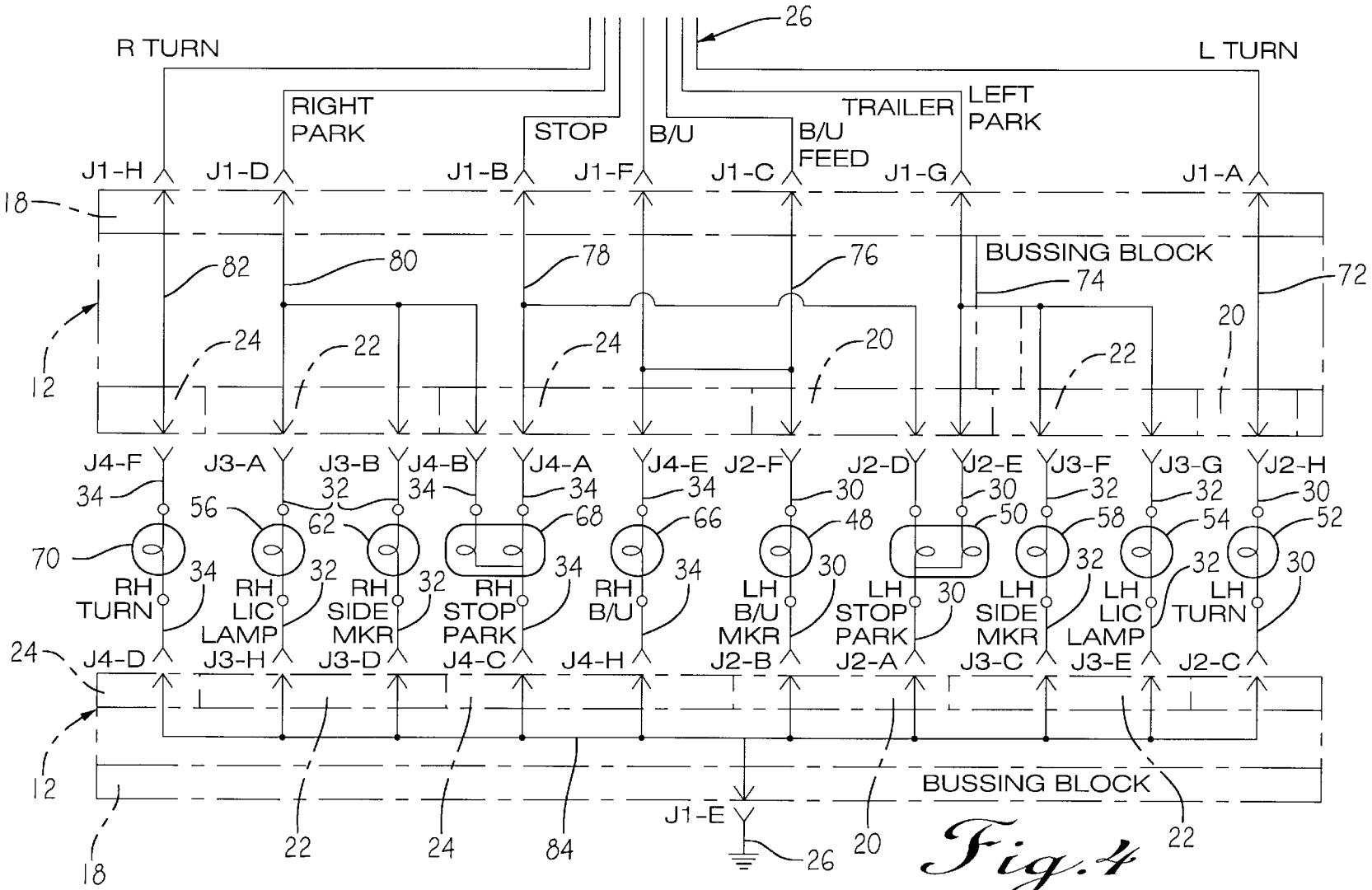
FIG. 4 is a wiring or circuit diagram for the power distribution system shown in FIGS. 1, 2 and 3.

Referring now to the wiring diagram of FIG. 4, left hand tail light assembly 13 includes a left hand back-up light 48 (that is conventionally behind a white lens), a left hand stop/park double filament light 50 (that is conventionally behind a red lens) and a left hand turn light 52 (that is behind a red lens or an amber lens depending on the country).

License plate light assembly 14 includes a left hand license light 54 and a right hand license light 56. Left hand license light 54 may be associated with a left hand side marker light 58 in an optional left hand side marker light assembly 60 as shown in FIG. 1. Right hand license light 56 may be associated with a right hand side marker light 62 in an optional right hand side marker light assembly 64. When optional side marker light assemblies 60 and 64 are used, the second wiring harness 32 for license plate light assembly 14 is branched and provided with end connectors that plug into the side light assemblies 60 and 64 to energize lights 58 and 62.

Right hand tail light assembly 15 includes a right hand back up light 66 (that is conventionally behind a white lens), a right hand stop/park double filament light 68 (that is conventionally behind a red lens) and a right hand turn light 70 (that is behind a red lens or an amber lens depending on the country).

Wiring Harness 26 plugs into input connector 18 via end connector 28 to feed the three light assemblies 13, 14 and 15 via output connectors 20, 22 and 24 and wiring harnesses 30, 32 and 34 as shown in FIGS. 1 and 2. The wiring diagram of FIG. 4 shows the power connection or wiring harness 26 to the input terminals and ground terminal in in connector 18. These terminals are labeled J1-A, J2-B, etc. in FIG. 4. J1 indicates wiring harness 26 while the letters A, B, etc. indicate the specific terminal labeled in socket 18 in FIG. 3.

Output connector 20 feeds the left hand tail light assembly 28 13 via end connected 36. The output terminals of output connector 20 are labeled J2-A, J2-B etc. in FIG. 4, with J2 indicating output connector 20 and the letters A, B etc. indicating the specific output terminal labeled in output connector 20 in FIG. 3. The output terminals of output connector feed lights 48, 50 and 52 via the individual leads of wiring harness 30.

Output socket 22 feeds license plate light assembly 14, left hand side marker light assembly 60, and right hand side marker light assembly 64, all via end connector 40. The output terminals of output connector 22 are labeled J3-A, J3-B in FIG. 4 with J-3 indicating output connector 22 and the letters A, B, etc. indicating the specific output terminal in output connector 22 in FIG. 3. The output terminals of output connector 22 feed lights 54, 56, 58, 62 via the individual leads of second wiring harness 32.

Output socket connector 24 feeds right hand tail light assembly 15 via end connector 44. The output terminals of output connector 24 are labeled J4-A, J4-B, etc. with J4 indicating output connector 24 and letters A, B, etc. indicating the specific output terminal in output connector 24 in FIG. 3. The output terminals of output connector 24 feed lights 66, 68 and 70 via the individual leads of wiring harness 34.

Figure 3:
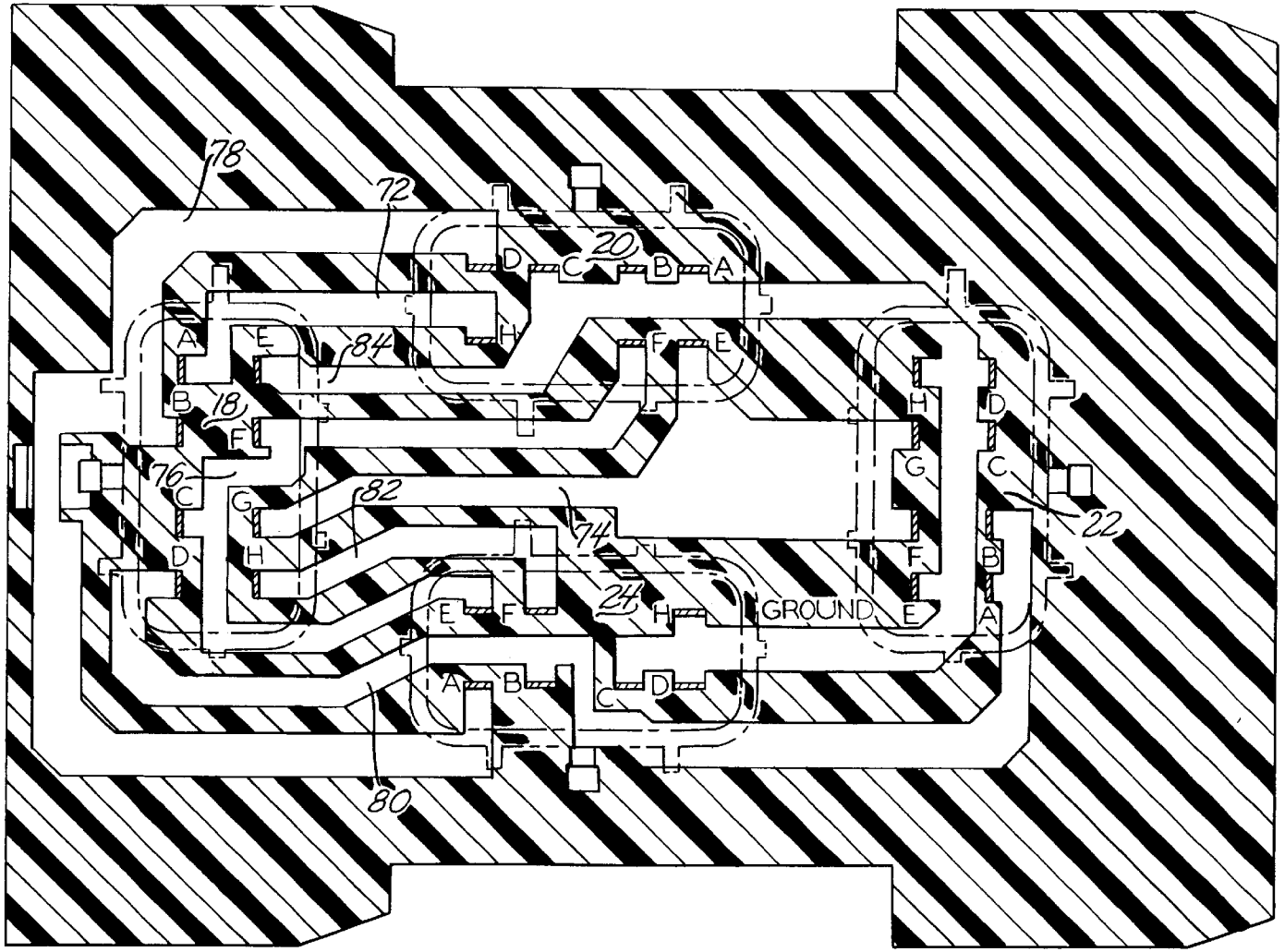
FIG. 3 is a section taken substantially along the line 3—3 of FIG. 2 looking in the direction of the arrows showing the bussing strips of a bussing block shown in FIGS. 1 and 2.

A plurality of conductive strips are embedded in bussing block 12 and are shown in plan view in FIG. 3 and diagramatically in FIG. 4. Each conductive strip is identified in FIG. 3 with a numeral 72, 74, 76, 78, 80, 82 or 84 and its counterpart is identified with the same numeral in the wiring diagram of FIG. 4. For instance the power feed conductor strip for left hand turn light 52 is identified by the numeral 72 in FIG. 3 and its diagramatic counterpart is also labelled 72 in The conductive strips 72–84 provide all of the necessary power distribution to the individual lights of the two tail light assemblies 13 and 15, the license plate light assembly 14 and optional side marker light assemblies 60 and 64 without any need for splices in either the chassis wiring harness 26 or any of the output wiring harnesses 30, 32 or 34.

Many modifications and variations of the present invention in light of the above teachings may be made. It is, therefore, to be understood that, within the scope of the appended claims, the invention may be practiced otherwise than as specifically described.

What is claimed is:

1. A power distribution system for a motor vehicle having a left tail light assembly, a license plate light assembly and a right tail light assembly comprising:

a bussing block having an input connector, a first output connector, a second output connector and a third output connector;

the bussing block having a plurality of bus strips with each of the bus strips having at least one terminal that is exposed in the input connector and at least one terminal that is exposed in at least one of the first, second and third output connectors;

a spliceless chassis wiring harness having an end connector mated to the input connector for energizing lights in the left tail light assembly, the license plate light assembly and the right tail light assembly;

a spliceless first output wiring harness operatively associated with the first output connector and the left tail light assembly;

a spliceless second output wiring harness operatively associated with the second output connector and the license plate light assembly, and a spliceless third output wiring harness operatively associated with the third output connector and the right tail light assembly.

2. The power distribution system as defined in claim 1 wherein the right and left tail light assemblies each include a turn light, a stop light and a back-up light.

3. The power distribution system as defined in claim 2 wherein the right and left tail light assemblies each include a double filament light that functions as the stop light and a park light.

4. The power distribution system as defined in claim 2 wherein the license plate light assembly includes a right license light and a left license light.

5. The power distribution system as defined in claim 2 further including a right side marker light assembly and a left side marker light assembly and wherein the right and left side marker light assemblies are operatively associated with the second output connector.

6. The power distribution system as defined in claim 3 wherein the license plate light assembly includes a right license light and a left license light.

7. The power distribution system as defined in claim 3 further including a right side marker light assembly and a left side marker light assembly and wherein the right and left side marker light assemblies are operatively associated with the second integral output connector socket.

8. The power distribution system as defined in claim 3 wherein the license plate light assembly includes a right license light and a left license light.

9. The power distribution system as defined in claim 3 further including a right side marker lamp assembly and a left side marker lamp assembly and wherein the right and left side marker lamp assemblies are operatively associated with the second output connector.

10. The power distribution system as defined in claim 1, wherein the input connector, the first output connector, the second output connector and the third output connector are sockets.

11. The power distribution system as defined in claim 10, wherein the sockets are integral to the bussing block and made of the same material.

12. The power distribution system as defined in claim 1, wherein the bussing block is molded about the plurality of bus strips thereby encapsulating the plurality of bus strips.

13. The power distribution system as defined in claim 1 wherein the bussing block is located at the rear of a vehicle, attached to a cross sill.

14. A power distribution system for a motor vehicle having a left tail light assembly, a license plate light assembly and a right tail light assembly comprising:

the right and left tail light assemblies each having a turn light, a stop light, a park light and a back-up light, the stop light and the park light contained within a single double filament light;

a bussing block attached to a vehicle cross sill at a location exposed to road conditions, the bussing block having an input connector, a first output connector, a second output connector and a third output connector, the connectors being sockets, the sockets integral to the bussing block;

the bussing block having a plurality of bus strips with each of the bus strips having at least one terminal that is exposed in the input connector and at least one terminal that is exposed in at least one of the first, second and third output connectors, the bussing block encapsulating the plurality of bus strips;

a spliceless chassis wiring harness having an end connector mated to the input connector for energizing lights in the left tail light assembly, the license plate light assembly and the right tail light assembly;

a spliceless first output wiring harness electrically connected with the first output connector and the left tail light assembly;

a spliceless second output wiring harness electrically connected with the second output connector and the license plate light assembly; and a spliceless third output wiring harness electrically connected with the third output connector and the right tail light assembly.

15. A power distribution system for a motor vehicle having a left tail light assembly, a license plate light assembly and a right tail light assembly comprising:

a bussing block having an input connector, a first output connector, a second output connector and a third output connector;

the bussing block having a plurality of bus strips with each of the bus strips having at least one terminal that is exposed in the input connector and at least one terminal that is exposed in at least one of the first, second and third output connectors, the plurality of bus strips lying flat within the same plane, the bussing block molded about and encapsulating the plurality of bus strips;

a spliceless chassis wiring harness having an end connector mated to the input connector for energizing lights in the left tail light assembly, the license plate light assembly and the right tail light assembly;

a spliceless first output wiring harness operatively associated with the first output connector and the left tail light assembly;

a spliceless second output wiring harness operatively associated with the second output connector and the license plate light assembly; and a spliceless third output wiring harness operatively associated with the third output connector and the right tail light assembly.

16. The power distribution system as defined in claim 15 wherein the right and left tail light assemblies each include a turn light, a stop light and a back-up light.

17. The power distribution system as defined in claim 16 wherein the right and left tail light assemblies each include a double filament light that functions as the stop light and a park light.

18. The power distribution system as defined in claim 17 wherein the license plate light assembly includes a right license light and a left license light.

19. The power distribution system as defined in claim 17 further including a right side marker light assembly and a left side marker light assembly and wherein the right and left side marker light assemblies are operatively associated with the second output connector.

* * * * *